United States Patent [19]

Akasaka et al.

[11] Patent Number: 4,996,955

[45] Date of Patent: Mar. 5, 1991

[54] INTAKE- AND/OR EXHAUST-VALVE TIMING CONTROL SYSTEM FOR INTERNAL COMBUSTION ENGINES

[75] Inventors: Akio Akasaka; Seiji Suga; Kenzi Ohizumi; Akiro Kadowaki; Masayuki Washio, all of Kanagawa, Japan

[73] Assignee: Atsugi Unisia Corporation, Kanagawa, Japan

[21] Appl. No.: 414,241

[22] Filed: Sep. 29, 1989

[30] Foreign Application Priority Data

| | | | |
|---|---|---|---|
| Sep. 30, 1988 | [JP] | Japan | 63-128918[U] |
| Oct. 13, 1988 | [JP] | Japan | 63-133668[U] |
| Oct. 13, 1988 | [JP] | Japan | 63-133669[U] |

[51] Int. Cl.[5] ..... F01L 1/34

[52] U.S. Cl. ..... 123/90.17; 123/90.31; 464/2

[58] Field of Search ..... 123/90.15, 90.17, 90.31; 464/1, 2, 24, 160

[56] References Cited

U.S. PATENT DOCUMENTS

| | | | |
|---|---|---|---|
| 3,734,073 | 5/1973 | Walter et al. . | |
| 4,231,330 | 11/1980 | Garcea | 123/90.15 |
| 4,494,495 | 1/1985 | Nakamura et al. | 123/90.17 |
| 4,494,496 | 1/1985 | Nakamura et al. | 123/90.17 |
| 4,535,731 | 8/1985 | Banfi | 123/90.17 |
| 4,561,390 | 12/1985 | Nakamura et al. | 123/90.17 |
| 4,811,698 | 3/1989 | Akasaka et al. | 123/90.31 |
| 4,841,924 | 6/1989 | Hampton et al. | 123/90.15 |

FOREIGN PATENT DOCUMENTS

| | | | |
|---|---|---|---|
| 3617140 | 11/1986 | Fed. Rep. of Germany . | |
| 0017214 | 1/1985 | Japan | 123/90.17 |
| 61-279713 | 12/1986 | Japan . | |
| 0003112 | 1/1987 | Japan | 123/90.17 |
| 2152193 | 7/1985 | United Kingdom | 123/90.17 |

*Primary Examiner*—David A. Okonsky
*Assistant Examiner*—Weilun Lo
*Attorney, Agent, or Firm*—Ronald P. Kananen

[57] ABSTRACT

An intake- and/or exhaust-valve timing control system for an internal combustion engine comprises an inner sleeve having an outer toothed portion, firmly connected to a front end of a camshaft, a cam sprocket having an inner toothed portion, connected through a timing chain to an engine crankshaft, and a ring gear mechanism including inner and outer toothed portions respectively meshing with the outer toothed portion of the sleeve and the inner toothed portion of the cam sprocket, for changing the intake and/or exhaust-valve timing of the engine. The valve timing control system also includes a knock-pin provided on the front end of the camshaft at a predetermined angular position of the camshaft and a positioning hole formed in the sleeve, for press-fitting the knock-pin thereinto, such that the location of the positioning hole determines the relative phase angle relationship between the knock-pin and a particular point on the outer cylindrical member which defines a reference angular position of the outer cylindrical member. Further provided is an adjusting screw, which engages one end of the ring gear member to provide axial sliding movement of the ring gear member, for fine adjusting the relative phase angle between the sleeve and the cam sprocket after installation of the ring gear member between the sleeve and the cam sprocket.

2 Claims, 4 Drawing Sheets

INTAKE- AND/OR EXHAUST-VALVE TIMING CONTROL SYSTEM FOR INTERNAL COMBUSTION ENGINES

BACKGROUND OF THE INVENTION

1. Field of the Invention

The present invention relates to an intake-and/or exhaust-valve timing control system which is optimally adapted for use in internal combustion engines. Particularly, the invention relates to a system which is variably capable of controlling the intake- and/or exhaust-valve timing depending upon the operating state of the engine, for instance, the magnitude of engine load or engine speed.

2. Description of the Prior Disclosure

Recently, there have been proposed and developed various intake- and/or exhaust-valve timing control systems for internal combustion engines for generating optimal engine performance depending upon the operating state of the engine.

As is generally known, valve timing is usually determined such that optimal engine performance is obtained; however, the predetermined valve timing is not suitable under all operating conditions. For example, when the engine is operating within a range of low revolutions, higher torque will be obtained with an intake-valve timing earlier than the predetermined valve timing.

Such a conventional intake- and/or exhaust-valve timing control system for internal combustion engines has been disclosed in U.S. Pat. No. 4,231,330. In this conventional valve timing control system, a cam sprocket having a driven connection with the engine crankshaft is rotatably supported through a ring gear mechanism at the front end of the cam shaft. The ring gear mechanism includes a ring gear having an inner toothed portion engaging another toothed portion formed on the front end of the camshaft and an outer toothed portion engaging an inner toothed portion formed on the inner peripheral wall of the cam sprocket. In this manner, the ring gear rotatably engages between the cam sprocket and the camshaft. The ring gear is normally biased in the axial direction of the camshaft by spring means, such as a coil spring. At least one of the two meshing pairs of gears is helical. The result is that axial sliding movement of the ring gear relative to the camshaft causes the camshaft to rotate about the cam sprocket and therefore the phase angle between the camshaft and the cam sprocket (and consequently, the phase angle between the camshaft and the crankshaft) is varied relatively. The ring gear moves as soon as one of the two opposing forces acting on it, namely the preloading pressure of the above spring means or the oil pressure applied from the oil pump through the flow control valve to the ring gear, exceeds the other. The conventional valve timing control system also includes an end disc locked on the front end of the camshaft by threading such that the end disc hermetically closes the front opening of the substantially cylindrical cam sprocket in an air-tight fashion. As is well known, when a crankshaft is connected through a timing chain or a timing belt to a camshaft, the phase angle between the crankshaft and the camshaft must be set to a predetermined value to obtain desirable valve timing. For this reason, timing marks may be indicated on the crank sprocket, the timing chain, and/or the cam sprocket for instance. However, in this conventional valve timing control system as previously described, when the end disc is screwed into the inner threaded portion formed in the center of the front end of the camshaft, the relative phase angle relationship between the cam sprocket and the camshaft is varied and as a result, the phase angle between the crankshaft and the camshaft is offset from the predetermined phase angle as well. Therefore, the phase angle between the camshaft and the cam sprocket must be adjusted after threading the end disc into the front end of the camshaft. Such phase angle adjustments are troublesome and time consuming.

SUMMARY OF THE INVENTION

It is therefore, in view of the above disadvantages, an object of the present invention to provide an intake-and/or exhaust-valve timing control system for internal combustion engines, in which the phase angle between a camshaft sprocket (or timing pulley) and a camshaft, that is the preset intake and/or exhaust valve timing relative to the crank angle, is easily and precisely adjusted.

In order to accomplish the aforementioned and other objects, an intake- and/or exhaust-valve timing control system for an internal combustion engine comprises an inner cylindrical member firmly connected to one end of the camshaft of the engine, an outer cylindrical member having a driven connection with the crankshaft of the engine, the outer cylindrical member being disposed in a manner so as to enclose the inner cylindrical member, means associated with the inner and outer cylindrical members, for changing the relative phase angle between the two cylindrical members in such a manner as to control intake and/or exhaust-valve timing of the engine, a knock-pin provided on the one end of the camshaft at a predetermined angular position and a positioning hole formed in the inner cylindrical member, for fitting the knock-pin thereinto. The positioning hole is located in a manner so as to be offset by a predetermined phase angle from a particular point defining a reference position on the outer cylindrical member. The predetermined phase angle defines the relative phase angle between the outer cylindrical member and the camshaft. The inner cylindrical member includes an outer toothed portion at the outer peripheral surface thereof, while the outer cylindrical member includes an inner toothed portion at the inner peripheral surface thereof. The phase angle changing means includes a ring gear member having inner and outer toothed portions respectively meshing with the outer toothed portion of the inner cylindrical member and the inner toothed portion of the outer cylindrical member. At least one of the meshing pairs of toothed portions is helical to provide sliding movement of the ring gear member in the axial direction of the camshaft for changing the relative phase angle between the two cylindrical members in such a manner as to control intake and/or exhaust-valve timing of the engine. The timing control system according to the invention may further require at least one of the inner or outer cylindrical members to be divided into two parts each being rotatable with respect to the other about the common axis of the camshaft so as to be capable of changing the relative phase angle between the two parts so as to adjust the phase angle between a particular point on the camshaft relative to the particular point on the outer cylindrical member. The particular point on the camshaft defines a reference angular position on the camshaft. The two parts are firmly connected to each other after completion of the phase angle adjustment between the two particular points on the camshaft and on the outer cylindrical member.

The timing control system of the invention may also further comprise means for finely adjusting the relative phase angle between the two cylindrical members after installation of the ring gear member between the two cylindrical members. This adjusting means includes an adjusting screw engaging one end of the ring gear member to provide axial sliding adjustment of the ring gear member.

DESCRIPTION OF THE PREFERRED EMBODIMENTS

The principles of the present invention applied to intake- and/or exhaust-valve timing control systems for internal combustion engines are illustrated in FIGS. 1 to 7.

Figure 1:
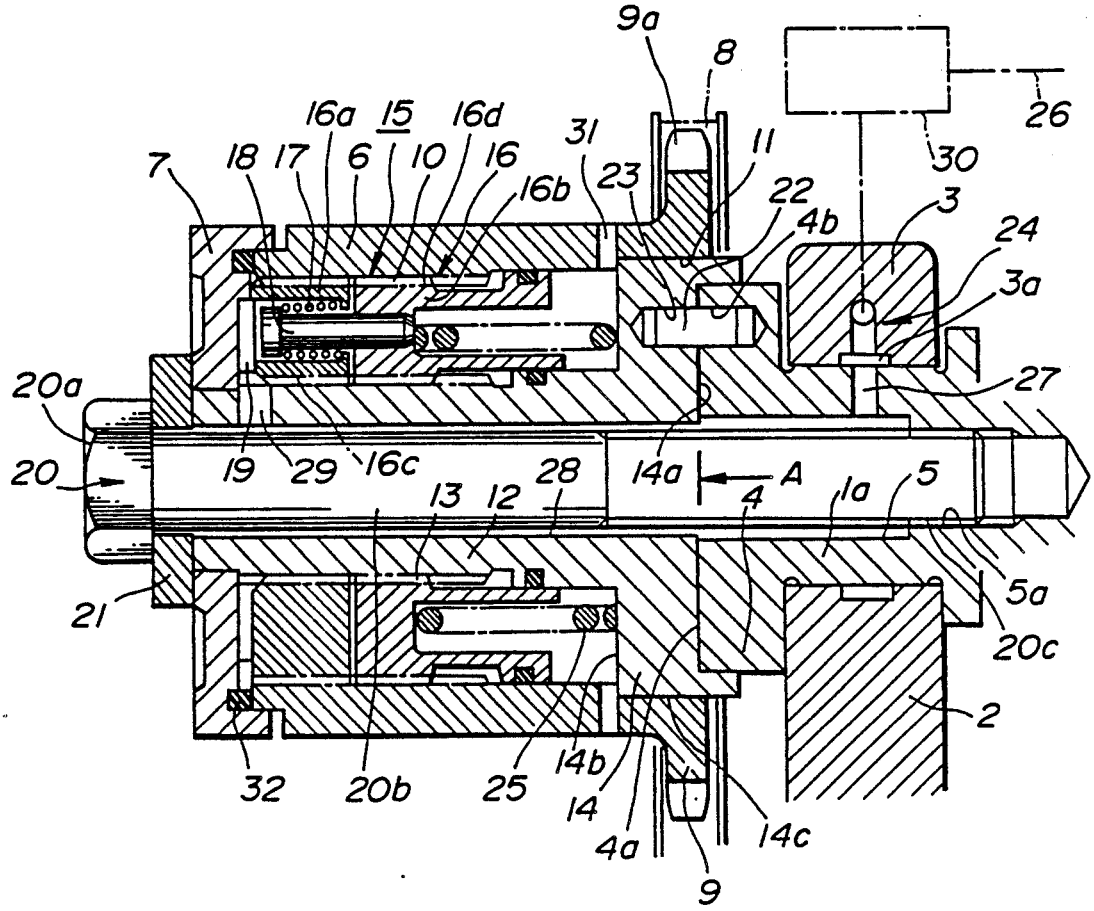
FIG. 1 is a cross sectional view illustrating an intake- and/or exhaust-valve timing control system of a first embodiment according to the invention.
Figure 2:
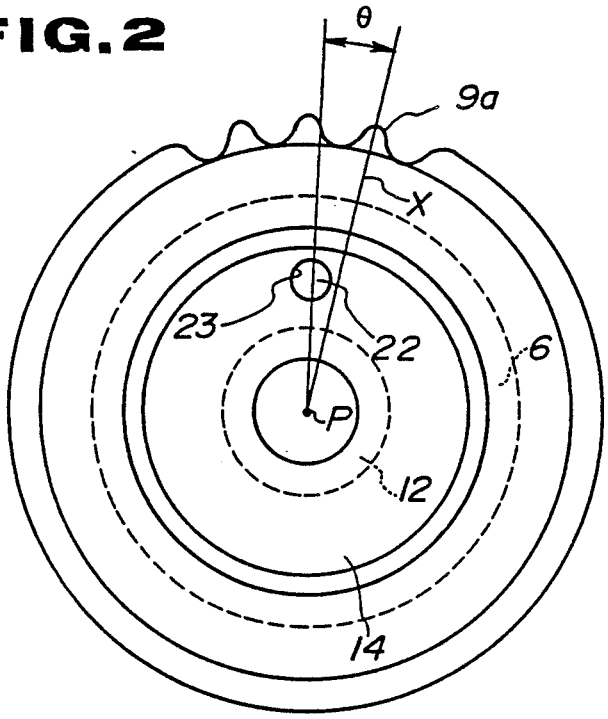
FIG. 2 is a view in the direction of arrow A of FIG. 1.

In the preferred embodiments, the same reference numerals used to designate elements in the first embodiment shown in FIGS. 1 and 2, will be applied to corresponding elements used in other embodiments for the purpose of comparing the respective embodiments.

First embodiment

FIG. 1 shows the front end section of a camshaft 1 provided for opening and closing an intake-and/or exhaust-valve (not shown). As clearly seen in FIG. 1, the camshaft 1 is journalled by a cylinder head 2 and a bearing member 3. An annular disc 4 is integrally formed at the front end 1*a* of the camshaft 1. The annular disc 4 has an annular, front flat surface 4*a*. Reference numeral 6 denotes an outer cylinder including a cam sprocket 9 driven by a timing chain 8 for transmitting torque from an engine crankshaft. The outer cylinder 6 includes a relatively long inner toothed portion 10 axially extending along the inner peripheral wall thereof. The outer cylinder 6 also includes a rear bore 11 having an inner diameter greater than the inner peripheral wall thereof. Reference numeral 12 denotes an inner cylinder integrally formed with a flange 14 having an annular, flat rear surface 14*a*, an annular, flat front surface 14*b*, and an outer peripheral surface 14*c*. The inner cylinder 12 includes an outer toothed portion formed on the outer peripheral surface thereof. The inner cylinder 12 is connected to the annular disc 4 to rotate with the camshaft 1 in such a manner that the rear surface 14*a* of the flange 14 abuts the front surface 4*a* of the disc 4. The outer circumferential portion of the flange 14 is rotatably fitted into the rear bore 11 of the outer cylinder 6 such that the outer peripheral surface 14*c* abuts the inner peripheral surface of the outer cylinder 6 defining the rear bore 11 in an airtight fashion.

A ring gear mechanism 15 is provided between the outer cylinder 6 and the inner cylinder 12. The ring gear mechanism 15 includes a ring gear member 16 which is comprised of a first ring gear element 16*a* and a second ring gear element 16*b*. The first and second ring gear elements 16*a* and 16*b* are formed in such a manner as to divide a relatively large ring gear including inner and outer toothed portions 16*c* and 16*d* into two parts by cutting or milling. Therefore, the first and second ring gear elements 16*a* and 16*b* have essentially the same geometry with regard to the inner and outer teeth. These ring gear elements 16*a* and 16*b* are interconnected by a plurality of connecting pins 18 which are fixed on the second ring gear element 16*b* through the annular hollow defined in the first ring gear element 16*a*. The annular hollow is traditionally filled with elastic material, such as a cylindrical rubber bushing attached by vulcanizing. Alternatively, as shown in FIG. 1, a plurality of coil springs 17 may be provided in the annular hollow, while the springs 17 are supported by the heads of the connecting pins 18 serving as spring seats. When the first and second ring gear elements 16*a* and 16*b*, and the connecting pins 18 are assembled, the first and second ring gear elements 16*a* and 16*b* are interconnected in such a manner as to be slightly offset from each other. In other words, the angular phase relationship between the ring gear elements 16*a* and 16*b* is designed so as to be set at an angular position slightly offset from an angular position in which the tooth traces between the two ring gear elements 16*a* and 16*b* are exactly aligned with each other. In these constructions, when the ring gear member 16 is installed between the outer and inner cylinders 6 and 12, the inner and outer toothed portions 16*c* and 16*d* are respectively meshed with the inner toothed portion 10 of the outer cylinder 6 and the outer toothed portion 13 of the inner cylinder 12. At least one of the two meshing pairs of teeth (10, 16*d*; 13, 16*c*) is helical to provide axial sliding movement of the ring gear relative to the camshaft 1. Furthermore, the previously described offset is preset to a slightly greater value than the offset of the ring gear member when meshed with its connecting toothed portions. The backlashes between the two meshing pairs of teeth (10, 16*d*; 13, 16*c*) are eliminated by the cylindrical rubber bushing or the coil springs 17 serving as a backlash eliminator.

An annular end plate 7 is fitted through a seal ring 32 into the front end of the outer cylinder 6 in an airtight fashion. The end plate 7 and the inner cylinder 12 are fixed together on the disc 4 of the camshaft 1, through a relatively thick plain washer 21 having a high rigidity, by a bolt 20 such that the bolt 20 is screwed through the cylindrical hollow defined in the inner cylinder 12 into a threaded portion 5*a* formed at the outermost end of the inner bore 5 defined in the front end 1*a* of the camshaft 1. When the bolt 20 is screwed into the front end 1*a* of the camshaft 1, the annular end plate 7 is firmly fixed on the inner cylinder 12 in such a manner that the inner peripheral surface of the end plate 7 is press-fitted into the outer peripheral surface of the front end of the inner cylinder 12. The bolt is comprised of a head 20*a*, an intermediate shaft section 20*b*, and a threaded section 20*c* engaging with the threaded portion 5*a* of the camshaft 1.

In these constructions, a pressure chamber 19 is defined by the inner wall of the end plate 7, the front end of the first ring gear element 16*a*, and the front end of the inner cylinder 12 for introducing working fluid fed from the oil pan (not shown) via the engine oil pump (not shown). As clearly seen in FIG. 1, the axially forward movement of the ring gear member 16 is restricted by the abutment between the inner wall of the end plate 7 and the front end of the first ring gear element 16*a*. Conversely, the axially backward movement of the ring gear member 16 is restricted by the abutment between the front surface 14*b* of the flange 14 and the the rear end of the second ring gear element 16*b*.

In the first embodiment according to the invention, note that the inner cylinder 12 and camshaft 1 are interconnected through a knock-pin 22 serving as a positioning pin. The knock-pin 22 is press-fitted into a hole 4*b* bored through the front surface 4*a* of the disc 4 in the axial direction of the camshaft 1. The hole 4*a* is bored in a position corresponding to a particular phase angle of the camshaft 1. On the other hand, a positioning hole 23 for the knock-pin 22 is axially bored through the rear surface 14*a* into the flange 14 of the inner cylinder 12. As shown in FIG. 2, the hole 23 is designed to be bored in the flange 14 such that the hole 23 is offset by a predetermined angle $\theta$ from a datum line X, drawn from the center P of the sprocket 9 to the top of a predetermined tooth 9*a* (for instance, as marked by the timing mark) of the sprocket 9, under a condition wherein the inner and outer cylinders 6 and 12 and the ring gear mechanism 15 are assembled as a unit. The holes 4*b* and 23 are formed in a manner so as to extend essentially the same distance relative to the axis of the camshaft 1. In this manner, the phase angle between the camshaft 1 and the sprocket 9 can be set to be always constant.

A ring gear drive mechanism for the previously described ring gear member 16 comprises a hydraulic circuit 24 for supplying and draining the working fluid from the oil pan to the pressure chamber 19, a compression spring 25 disposed between the second ring gear element 16*b* and the flange 14 for normally biasing the ring gear member 16 in an axially forward direction, and an electromagnetic flow control valve 30 for controlling the amount of the working fluid flowing through the hydraulic circuit 24. As shown in FIG. 1, the hydraulic circuit 24 includes an oil supply passage 27 radially extending in the camshaft 1, an intermediate oil passage 28 defined between the outer periphery of the shaft section 20*b* of the bolt 20 and the inner peripheries of the inner cylinder 12 and the front end 1*a* of the camshaft 1, a communication passage 29 intercommunicating the pressure chamber 19 and the intermediate oil passage 28, and an exhaust passage 31 bored in the outer cylinder 6 in the vicinity of the sprocket 9 for intercommunicating a rear fluid chamber employing a return spring 25 and an internal space defined by the cylinder head 2 and the cylinder head cover (not shown). The oil supply passage 27 communicates upstream thereof through an annular oil passage 3*a* defined between the outer peripheral surface of the front journalled section of the camshaft 1 and the semi-circular curved surface of the cylinder head 2 and the bearing member 3, via the flow control valve 30, a main oil gallery 26, with the oil pump (not shown). The flow control valve 30 is controlled by a controller (not shown) which determines the operating state of the engine on the basis of signals output from various sensors, such as a crank angle sensor for monitoring the crank angle of the crankshaft, and an air flow meter for monitoring the amount of intake air introduced through the air cleaner.

The intake- and/or exhaust-valve timing control system for internal combustion engines according to the invention, operates as follows.

When the engine is operating under low load, the control signal from the previously described controller is in an OFF state, with the result that the flow control valve 30 blocks the flow of working fluid fed through the oil supply passage 27 to the pressure chamber 19. Since the oil within the pressure chamber is exhausted through apertures defined between the two meshing pairs of teeth (10, 16*d*; 13, 16*c*) via the exhaust passage 31 to the internal space defined by the cylinder head 2 and the cylinder head cover, the pressure within the pressure chamber 19 becomes low, while the working fluid flowing through the above mentioned apertures serves to lubricate the ring gear mechanism 15. As a result, as shown in FIG. 1, the ring gear member 16 is positioned at the leftmost position (viewing FIG. 1) by the spring 25. Under this condition, the relative phase angle between the sprocket 9 and the camshaft 1 is set to a predetermined phase angle in which intake- and/or exhaust-valve timing relative to the crank angle is initialized.

Conversely, when the operating state of the engine is changed from a low load to a high load, the control signal from the controller is in an ON state, with the result that the pressurized working fluid from the oil pump (not shown) is through the main oil gallery 26, the flow control valve 30, and the oil supply passage 27, to the pressure chamber 19, in that order. As a result, since the pressure within the pressure chamber 19 becomes high, the ring gear member 16 is moved in the right direction (viewing FIG. 1) against the spring force generated by the spring 25. Therefore, the phase angle between the outer cylinder 6 and the inner cylinder 12 (corresponding to the phase angle between the outer cylinder 6 and the camshaft 1) is relatively changed to a predetermined phase angle which corresponds to an optimal phase angle during high engine load conditions. In this manner, the intake- and/or exhaust-valve timing is variably controlled dependent upon the operating state of the engine.

As will be appreciated from the above, if the knock-pin 22 is fitted into the positioning hole 23, when the inner and outer cylinders 6 and 12 and the ring gear mechanism 15 assembled as a unit is installed on the front end 1*a* of the camshaft 1, the phase angle between the sprocket 9 and the camshaft 1 is naturally set to a predetermined value to obtain an optimal intake- and/or exhaust-valve timing relative to the crank angle. As set forth above, since in the intake-and/or exhaust-valve timing control system of the first embodiment according to the invention, the phase angle between the sprocket 9 and the camshaft 1 is determined by only the two positioning holes 4*b* and 23 and the knock-pin 22, the complicated structure for finely adjusting the phase angle between the sprocket 9 and the camshaft 1 is avoided. Although the knock-pin 22 is press-fitted into the hole 4*b* bored in the annular disc 4 in the axial direction of the camshaft 1, the knock-pin may also be press-fitted into a hole bored in the annular disc 4 in the radial direction of the camshaft 1 as a positioning device for determining the phase angle between the sprocket 9 and the camshaft 1. In this first embodiment, since the phase angle between the sprocket 9 and the camshaft 1 is determined by the two holes 4*b* and 23, the machining accuracy of the two holes must be extremely high.

Second embodiment

Figure 3:
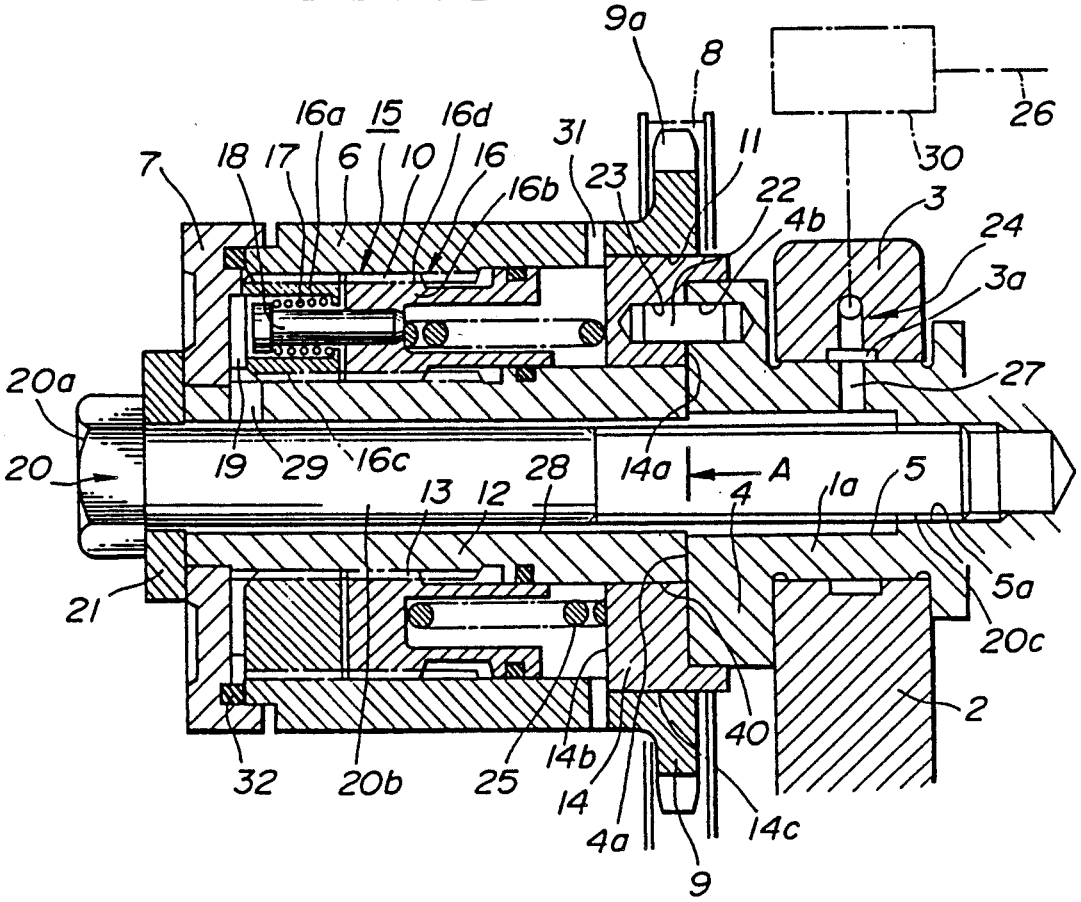
FIG. 3 is a cross sectional view illustrating an intake- and/or exhaust-valve timing control system of a second embodiment according to the invention.

As shown in FIG. 3, the second embodiment is different from the first embodiment in that the inner cylinder 12 is divided into two parts, namely an inner cylindrical section having a relatively long outer toothed portion 13 at the outer peripheral surface thereof, and an annular flange section 14 having a positioning hole 23. Reference numeral 40 denotes the division between the inner cylindrical section 12 and the flange section 14. The rear, inner cylindrical section 12 is softly fitted to the flange section 14 at the division 40. The construction of the ring gear mechanism 15 and the ring gear drive mechanism is exactly the same as in the first embodiment.

Figure 4:
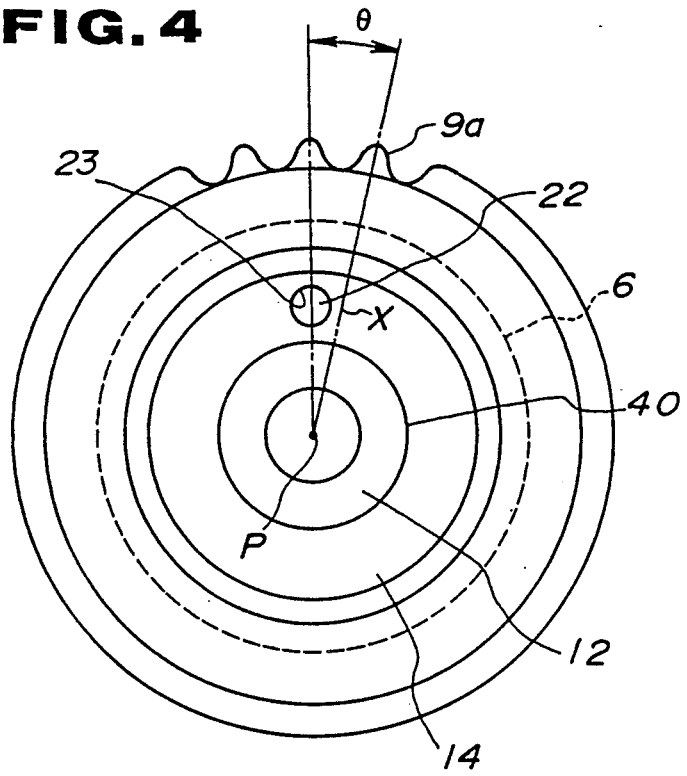
FIG. 4 is a view in the direction of arrow A of FIG. 3.

Referring now to FIGS. 3 and 4, the phase angle between the sprocket 9 and the camshaft 1 is adjusted as follows:

After the inner and outer cylinders 6 and 12, and the ring gear mechanism 15 are assembled as a unit, the flange section 14 is rotated relative to the inner cylindrical section such that the positioning hole 23 previously bored through the rear surface 14*a* in the flange 14 is matched to an angular position wherein the hole 23 is offset by the predetermined phase angle $\theta$ from the datum line X as clearly seen in FIG. 4. When matched, the inner cylindrical section and the flange section 14 are firmly connected to each other at the division 40 by laser welding. Subsequently, the connected inner cylinder assembly 12 is firmly secured through the annular disc 4 to the front end 1*a* of the camshaft 1 by the bolt 20, while the knock-pin 22 is press-fitted into the hole 23. In this manner, the phase angle between the sprocket 9 and the camshaft 1 is easily and precisely set to a predetermined value.

A modification of the second embodiment of the invention will be described hereinbelow.

Figure 5:
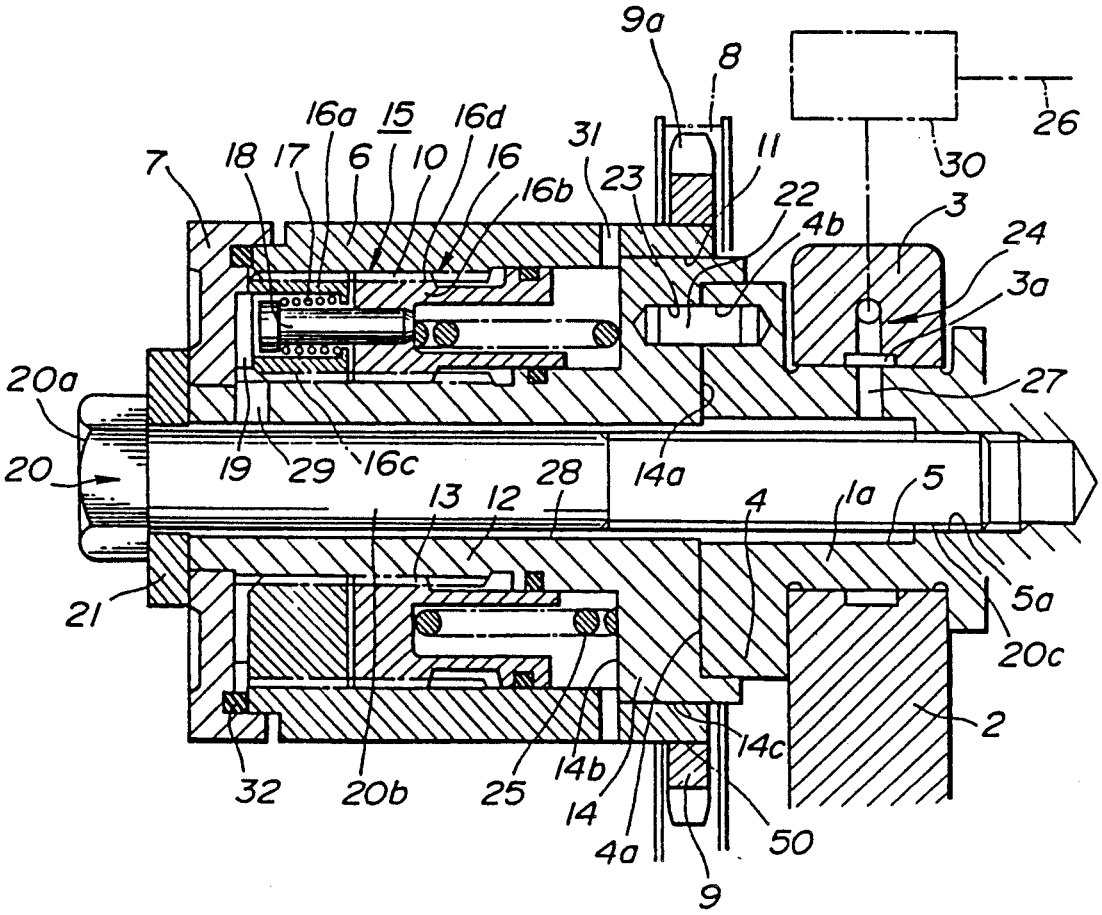
FIG. 5 is a cross sectional view illustrating a modification of the intake- and/or exhaust-valve timing control system of the second embodiment shown in FIG. 3.

As shown in FIG. 5, this modification is different from the second embodiment shown in FIGS. 3 and 4 in that the outer cylinder 6 instead of the inner cylinder 12 is divided into two parts, namely an outer cylindrical section having a relatively long inner toothed portion 10 and a sprocket section 9. Reference numeral 50 denotes a divided surface between the outer cylindrical section and the sprocket section 9. The rear, outer cylindrical section is softly fitted to the sprocket section at the divided surface 50.

The phase angle between the sprocket 9 and the camshaft 1 is adjusted as follows.

First, the assembled unit with the inner and outer cylinders 6 and 12, and the ring gear mechanism 15 is firmly secured to the front end 1*a* of the camshaft 1 by the bolt 20. The sprocket 9 is rotated relative to the outer cylindrical section such that the top of the predetermined tooth 9*a* is matched to an angular position wherein the top of the predetermined tooth 9*a* is offset by the predetermined phase angle $\theta$ from the angular position of the knock-pin 22 or the positioning hole 23. When matched, the outer cylindrical section and the sprocket 9 are firmly connected to each other at the divided surface 50 by laser welding. In this manner, the phase angle between the sprocket 9 and the camshaft 1 is easily adjusted. In the above mentioned modification of the second embodiment, although the sprocket section is fixed on the outer cylindrical section at the matched position by laser welding after the previously described unit is firmly secured to the front end of the camshaft 1 by the bolt 20, the sprocket section may be positioned and fixed on the outer cylindrical section before the unit is secured to the camshaft 1, according to the installation method as described in the second embodiment. Since in the modification, the sprocket section 9 is separated from the outer cylindrical section, the sprocket itself can be formed by pressing. Furthermore, the outer cylinder section may be formed of pipe materials. Therefore, the cost of these parts is decreased, thereby reducing the overall cost of the intake- and/or exhaust-valve timing control system.

Third embodiment

Figure 6:
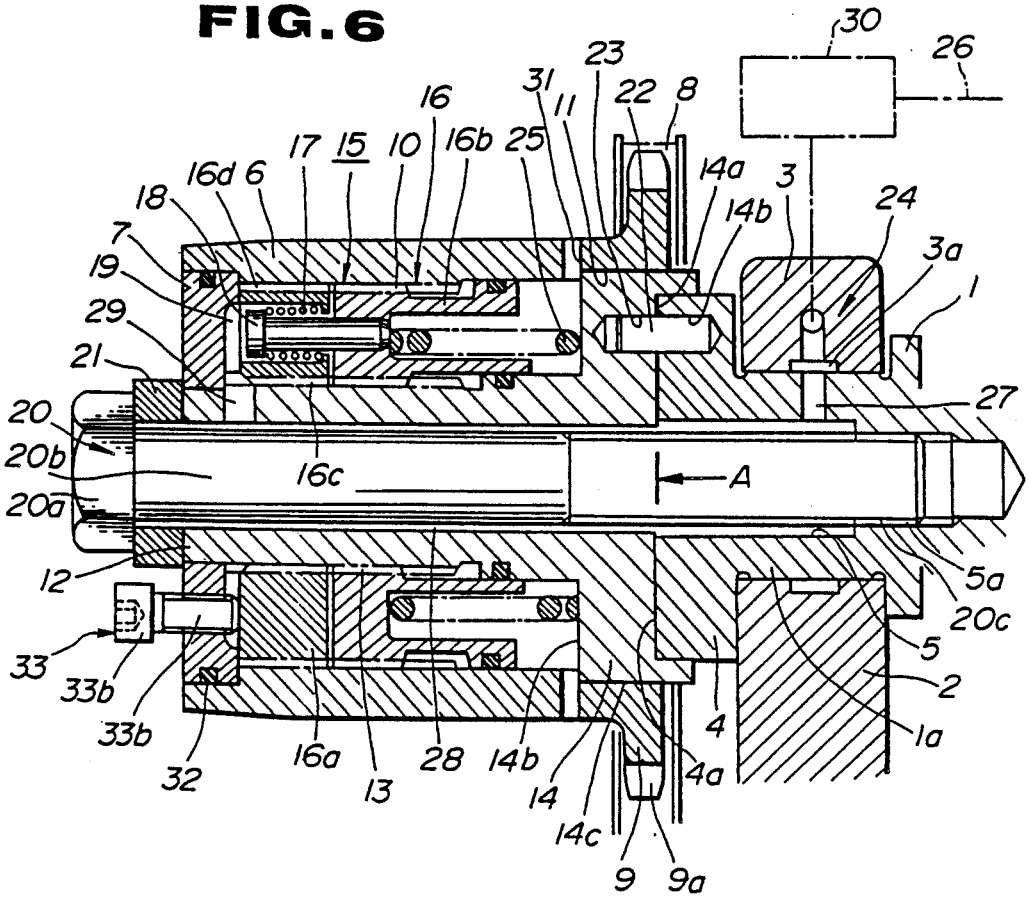
FIG. 6 is a cross sectional view illustrating an intake- and/or exhaust-valve timing control system of a third embodiment according to the invention.
Figure 7:
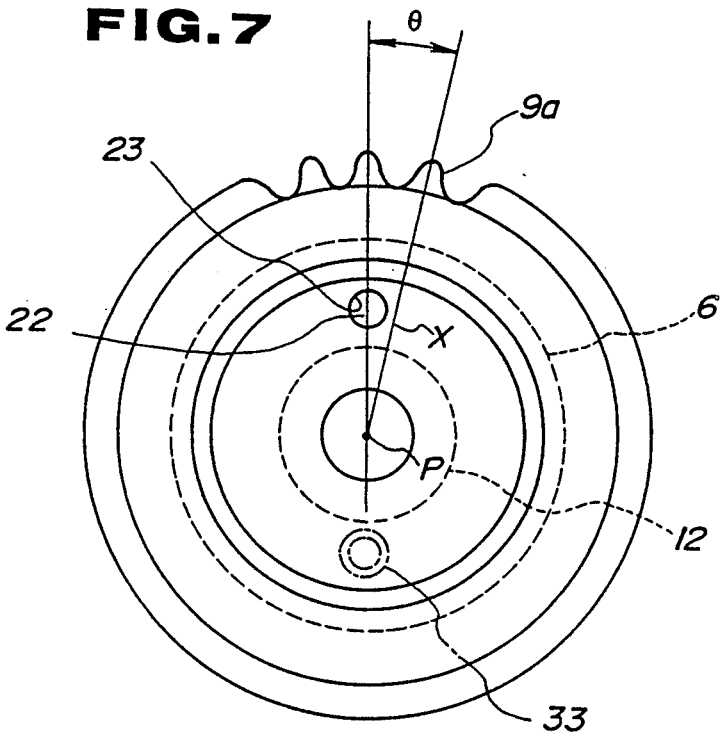
FIG. 7 is a view in the direction of arrow A of FIG. 6.
Figure 6:
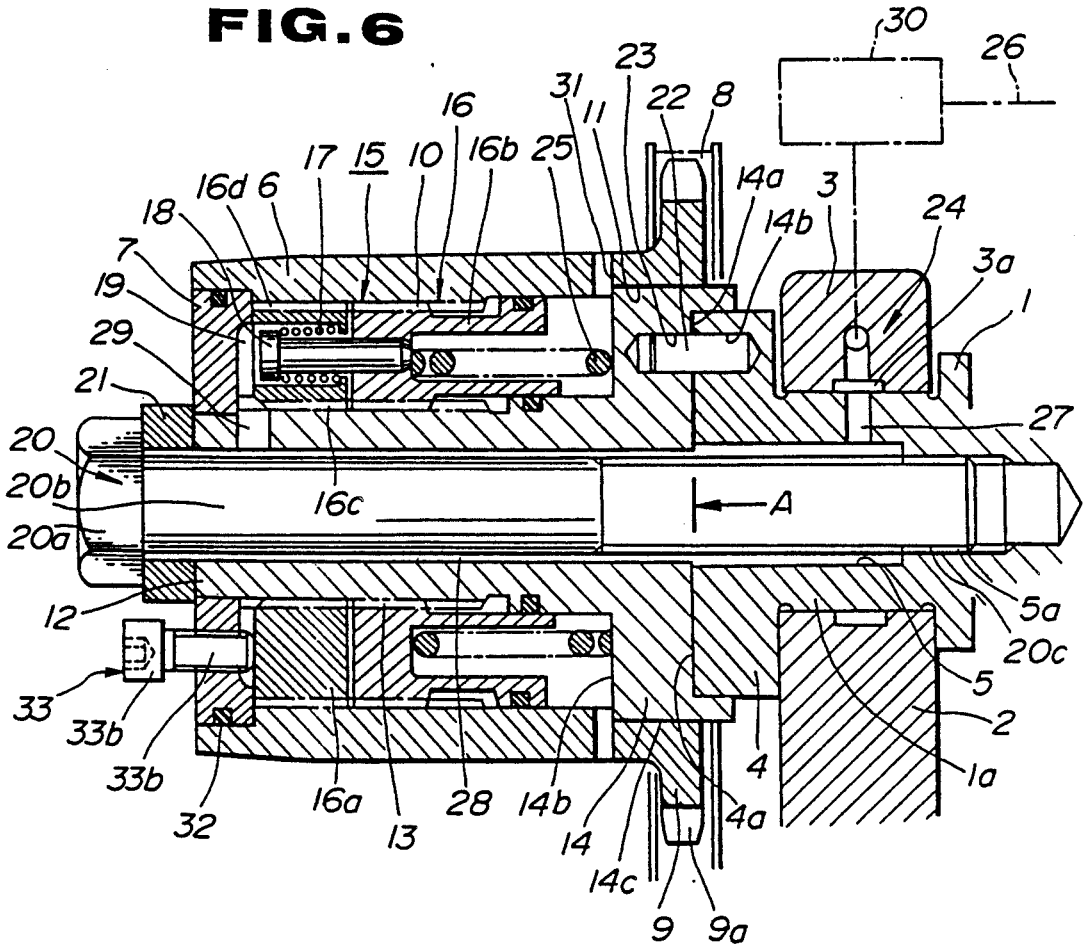
Figure 7:
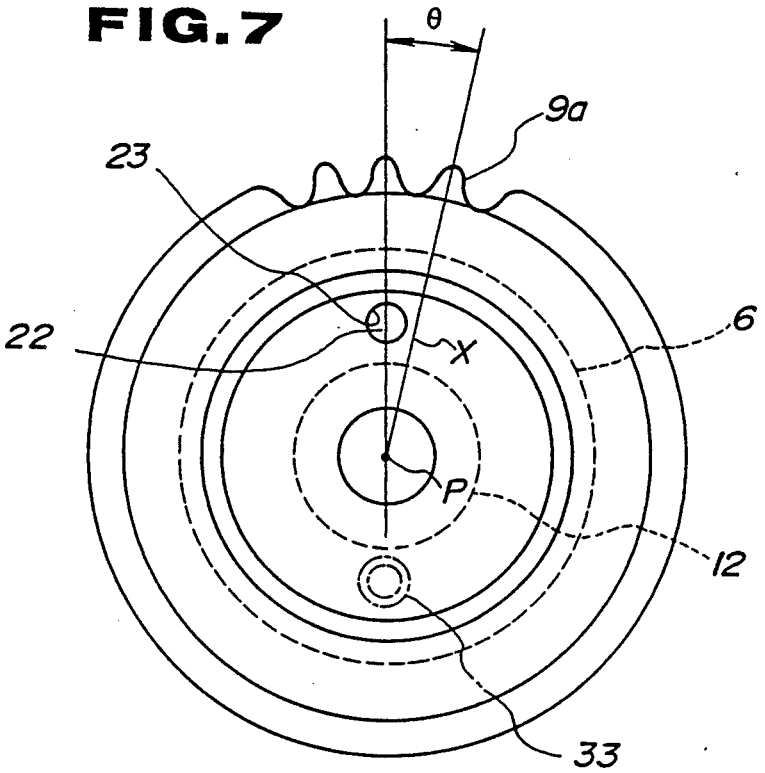

As shown in FIG. 6, the third embodiment is different from the first embodiment shown in FIGS. 1 and 2 in that an adjusting screw 33 including a head 33*a* and a threaded shaft 33*b* is attached to the end plate 7 and the positioning hole 23 is previously bored in the flange 14 of the inner cylinder 12. As previously described, the positioning hole 23 according to the first embodiment must be bored with an extremely high machining accuracy after the position of the hole 23 is precisely determined in a relative phase angle relationship between the knock-pin 22 and the predetermined tooth 9*a* of the sprocket 9 in accordance with the positioning method shown in FIG. 2. However, assuming that the angular position of the hole 23 is slightly offset from a predetermined position, a device for fine adjusting or compensating the offset is preferably included. In the third embodiment, an adjusting screw 33 is therefore provided for finely adjusting or compensating such an offset. The adjusting screw 33, for example, a hexagon socket head cap screw, adjusts the phase angle between the sprocket 9 and the camshaft 1 such that the the top end of the threaded shaft 33*b* of the adjusting screw 33 moves the ring gear member 16 in the axial direction in a manner so as to screw the head 33*a* around by means of a hexagon socket screw key.

The phase angle between the sprocket 9 and the camshaft 1 is adjusted in accordance with the following procedure.

First, the inner and outer cylinders 6 and 12, and the ring gear mechanism 15 are assembled as a unit. Under this condition, if the phase angle between the top of the predetermined tooth 9*a* of the sprocket 9 and the hole 23 is different from the predetermined phase angle $\theta$, the adjusting screw 33 is for instance rotated clockwise and the top end of the threaded shaft 33*b* of the screw 33 pushes the front end of the first ring gear element 16*a* and therefore the ring gear member 16 is moved in the right direction (viewing FIG. 6). As a result, the outer cylinder 6 rotates in a predetermined direction depending upon the direction of the tooth traces of the helical gear, since at least one of the two meshed pairs of toothed portions (10, 16*d*; 13, 16*c*) is helical. While the screw 33 is rotated counterclockwise, the ring gear member 16 is returned to the left direction (viewing FIG. 6) by the spring 25 and as a result the outer cylinder 6 is rotated in a direction opposing the above mentioned predetermined direction. In this manner, the outer cylinder 6 is rotated relative to the inner cylinder 12 and thus the phase angle between the sprocket 9 and the camshaft 1 is finely adjusted such that the hole 23 is precisely offset by the predetermined phase angle $\theta$ from the datum line X as clearly seen in FIG. 7. After this, the fine adjusted unit is firmly secured to the front end 1*a* of the camshaft 1 by the bolt 20, while the knock-pin 22 is press-fitted into the hole 23. In this way, the phase angle between the sprocket 9 and the camshaft 1 is easily and precisely set to a predetermined value at the same time when the unit is assembled on the front end of the camshaft 1.

In the above described embodiment, although a camshaft sprocket associated with a timing chain is used for the timing control system according to the invention, the camshaft sprocket may be replaced with a timing pulley associated with a timing belt.

While the foregoing is a description of the preferred embodiments for carrying out the invention, it will be understood that the invention is not limited to the particular embodiments shown and described herein, but may include variations and modifications without departing from the scope or spirit of this invention as described by the following claims.

What is claimed is:

1. An intake- and/or exhaust-valve timing control system for an internal combustion engine comprising:

an inner cylindrical member firmly connected to one end of a camshaft of the engine, said inner cylindrical member including an outer toothed portion at the outer peripheral surface thereof;

an outer cylindrical member having a driven connection with a crankshaft of the engine, said outer cylindrical member including an inner toothed portion at the inner peripheral surface thereof;

a ring gear member including inner and outer toothed portions at the inner and outer peripheral surfaces thereof, the inner and outer toothed portions being respectively meshed with the outer toothed portion of the camshaft and the inner toothed portion of said outer cylindrical member, at least one of the two meshing pairs of toothed portions being helical to provide sliding movement of said ring gear member in the axial direction of the camshaft, for changing a relative phase angle between the two cylindrical members in such a manner as to control intake- and/or exhaust-valve timing of the engine; and means for fine adjusting a relative phase angle between the two cylindrical members after installation of said ring gear member between the two cylindrical members, said adjusting means including an adjusting screw engaging one end of said ring gear member to provide axial sliding movement of said ring gear member.

2. The intake- and/or exhaust-valve timing control system of claim 1, which further comprises:

a knock-pin provided on said one end of the camshaft, at a predetermined angular position of the camshaft; and a positioning hole formed in said inner cylindrical member, for fitting said knock-pin thereinto, the position of said positioning hole being determined in a relative phase angle relationship between said knock-pin and a particular point on said outer cylindrical member, said particular point defining a reference angular position of said outer cylindrical member.

* * * * *